US005159243A

United States Patent [19]

Rohde

[11] Patent Number: 5,159,243

[45] Date of Patent: Oct. 27, 1992

[54] HOLLOW ELECTRODE SWITCH

[75] Inventor: Klaus-Dieter Rohde, Erlangen, Fed. Rep. of Germany

[73] Assignee: Siemens Aktiengesellschaft, Berlin & Munich, Fed. Rep. of Germany

[21] Appl. No.: 857,722

[22] Filed: Mar. 26, 1992

Related U.S. Application Data

[63] Continuation of Ser. No. 627,017, Dec. 13, 1990, abandoned.

[30] Foreign Application Priority Data

Dec. 20, 1989 [EP] European Pat. Off. ..... 89123566.5

[51] Int. Cl.[5] ..... H02H 9/04

[52] U.S. Cl. ..... 315/111.01; 313/360.1; 361/120

[58] Field of Search ..... 315/111.01, 334, 337; 313/360.1; 361/120, 130

[56] References Cited

U.S. PATENT DOCUMENTS

| | | | |
|---|---|---|---|
| 3,328,632 | 6/1967 | Robinson | 361/120 X |
| 3,710,191 | 1/1973 | Peche | 361/120 |
| 4,104,693 | 8/1978 | Toda et al. | 361/120 |
| 4,283,747 | 8/1981 | Perkins, Jr. | 361/120 X |
| 4,335,465 | 6/1982 | Christiansen et al. | 313/360.1 X |
| 4,433,354 | 2/1984 | Lange et al. | 361/120 |
| 5,091,819 | 2/1992 | Christiansen et al. | 313/231.11 X |

*Primary Examiner*—Eugene R. LaRoche
*Assistant Examiner*—Do Hyun Yoo
*Attorney, Agent, or Firm*—Kenyon & Kenyon

[57] ABSTRACT

A hollow electrode switch contains at least two electrodes, which form a discharge gap for a low-pressure gas discharge and with which a hollow or cavity electrode is associated. A space charge generator, in particular a glow discharge, is provided inside the hollow electrode. This hollow electrode is intended as anode for the space charge and is electrically insulated from the electrodes. Thus one obtains an especially simple design form of the hollow electrode switch which has short switching delay and little jitter as operating characteristics.

19 Claims, 1 Drawing Sheet

HOLLOW ELECTRODE SWITCH

This application is a continuation of application Ser. No. 07/627,017 filed Dec. 13, 1990 now abandoned.

BACKGROUND OF THE INVENTION

The present invention relates to a hollow or cavity electrode switch and more particularly to such a switch with an anode, a cathode and at least one opening for a discharge gap in which pressure of an ionizable gas p and electrode spacing d are selected so that the starting voltage of the gas discharge decreases with increasing product p×d.

The starting voltage for a given gas discharge gap and its usual graph representation as a function of the product of gas pressure p and electrode spacing d in the ignition characteristic is known to constitute (with due consideration of the ignition probability) an important aid for defining electrical discharge devices. For the determination of the dielectric strength of a given gas discharge gap, a comparison is generally made with an infinitely large plate capacitor and the ignition characteristic of such a configuration. However, the practical form of realization of such discharge gaps has electrodes with finite dimensions. For examining the so-called "far breakdown" region including the voltage minimum which involves the determination of the right branch of the ignition characteristic (Paschen curve), it suffices to arrange two flat rounded plates parallel to each other. The plates can have edges having a so-called Rogowski profile. Such a structural arrangement is unusable for the study of ignition characteristics in the left portion of the Paschen curve, i.e., in the so-called "near breakdown" region, because detour discharges may occur. Such detour discharges can be avoided by an electrode construction with flat plate electrodes which are arranged coaxial to each other; bent away from each other at their edges with a radius of curvature that is small relative to the electrode spacing; to extend along the inner cylindrical insulator surface. Thus, a gap is always formed between the bent-away cylindrical edge region of the electrodes and the inside wall of the hollow-cylindrical insulator. With this design form of a low-pressure gas discharge gap it is possible to determine the ignition characteristic for various rare and molecular gases also in the near breakdown region, i.e., to the left of the minimum of the Paschen curve.

Gas discharge switches which are controlled by a pulsed low-pressure gas discharge are also known. They switch, for example, currents of 10 kA at a voltage of 20 kV. The discharge switch contains an anode and a cathode, which are provided with coaxial openings and are separated from each other at their edges by an annular insulator. For the gas discharge a control system is provided which contains a cage type hollow or cavity electrode which is electroconductively connected with the cathode and hence is at the cathode potential. It embraces the cathode back chamber and separates the latter from the region of a pre-ionization. The gas discharge between the cathode and the anode is started by injection of charge carriers The ignition of the discharge gap occurs in two stages. First a preionization is produced by an auxiliary electrode through a glow discharge. Then a trigger electrode receives a negative igniting pulse. The entry of charge carriers into the hollow electrode is made possible by the fact that the potential of a blocking electrode is set to zero. The discharge is initiated with the entry of the charge carriers into the hollow electrode. Such a device is disclosed in J. Phys. E: Sci. Instr. 19 (1986), The Inst. of Physics, Great Britain, pages 466 to 470.

U.S. Pat. No. 2,900,566 discloses another design for a gas discharge switch, wherein a plurality of electrodes is provided which are arranged coaxial to each other and which form a common discharge channel. Several intermediate electrodes are arranged between the anode and cathode.

The gas discharge switch may also contain several discharge channels which are provided with a common trigger means. This trigger means contains a common hollow electrode which is electroconductively connected to the common cathode. The synchronous ignition of the discharge channels is initiated by charge carriers which enter from a pre-ionization region through holes in the bottom of the cage into the cathode back chamber. Such a switch is disclosed in J. Phys. E.: Sci. Instr. 20 (1987), p. 270 to 273.

SUMMARY OF THE INVENTION

The present invention provides a simplified and improved design for a hollow or cavity electrode switch In particular, the present invention provides a simplified ignition system for the hollow electrode switch.

The present invention is a hollow or cavity electrode switch that includes a switching chamber and first and second electrodes disposed in the chamber. The first and second electrodes are disposed at a distance "d" from each other to form a discharge gap. A trigger system including a hollow electrode is associated with the discharge gap. The switching chamber contains an ionizable gas whose pressure "p" is selected so that the starting voltage of the gas discharge decreases with increasing product p×d. The hollow electrode includes a space charge generator. In the hollow electrode, at least one space charge, preferably a glow discharge, is produced In this embodiment, the hollow electrode, electrically insulated from the reference electrode, combines the function of the pre-ionization and of the trigger electrodes, and a special blocking electrode is no longer needed.

A glow cathode arranged between the reference electrode and the bottom of the hollow electrode may be provided for generating the space charge required for the ignition of the discharge gap. The space charge may also be produced by a microwave excitation or by an optical ignition system, such as a laser beam.

In an especially advantageous embodiment of the hollow electrode switch of the present invention, the space charge required for ignition of the discharge gap is made available by a glow discharge. For this purpose the hollow electrode may be connected in a simple manner to a trigger voltage source for a negative trigger voltage of sufficient energy. The hollow electrode forms the anode, and the reference electrode disposed opposite an opening of the hollow electrode forms the cathode for the glow discharge.

In a further embodiment, the hollow electrode can be connected also to an additional voltage source with a positive potential for a pre-ionization. This preionization creates a low-current glow discharge inside the hollow electrode. This does not yet lead to the firing of the discharge gap. By this glow discharge the dielectric strength at the discharge gap, and hence the stability of the switch, is improved. The ignition of the discharge gap is produced by the trigger electrode by a superposed negative trigger pulse with steep leading edge and short duration. The reference electrode is given a two-fold function; it forms both a cathode for the gas discharge at the discharge gap and, on its back side, away from the discharge gap, a cathode for the glow discharge. In this embodiment, one obtains a hollow electrode switch with very short switching delay and little jitter; further one obtains a substantially reduced voltage dependence at equal pressure for the hollow electrode switch.

DETAILED DESCRIPTION

Figure 1:
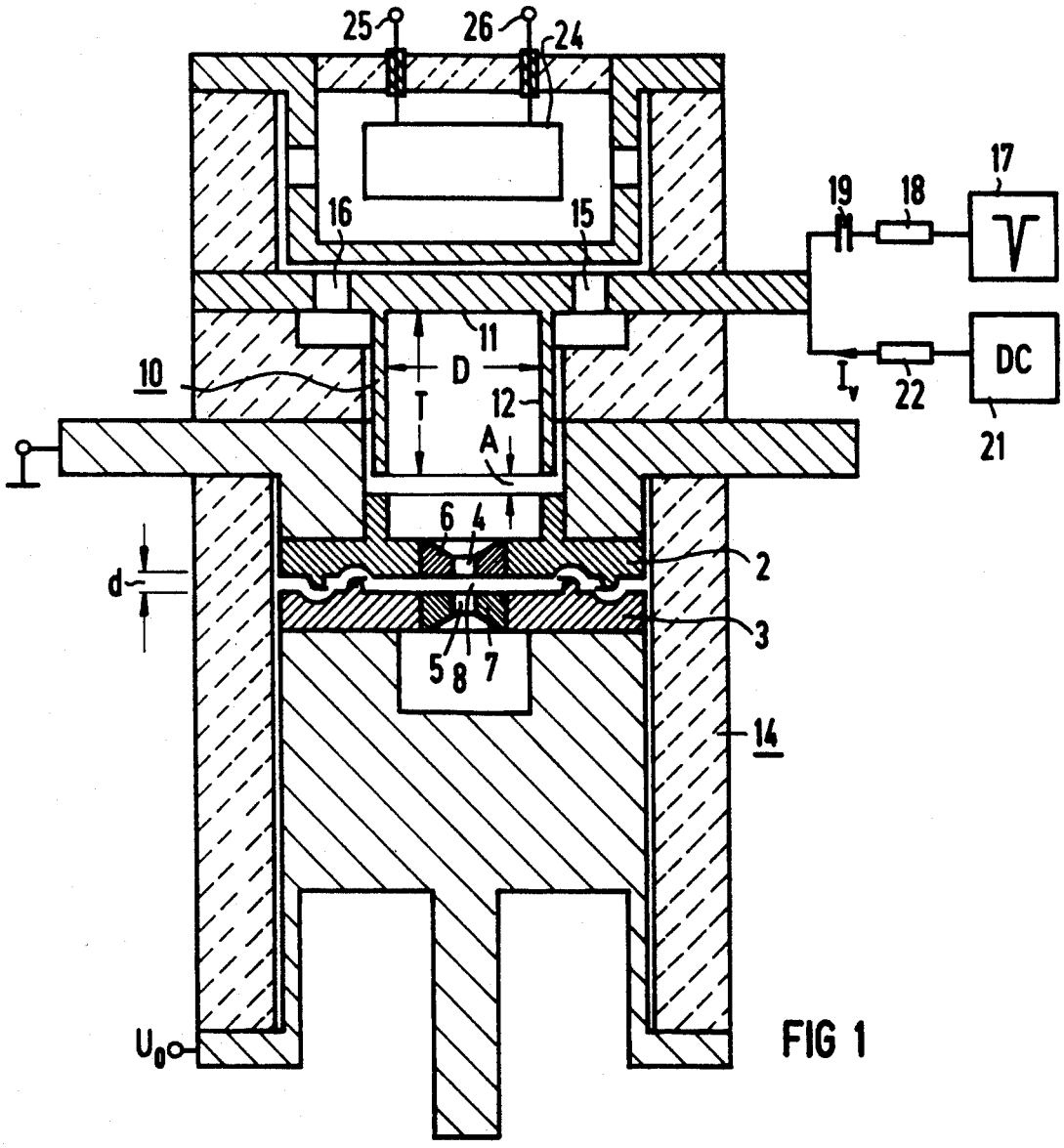
FIG. 1 is a schematic illustration of a hollow electrode switch according to an embodiment of the present invention.

A hollow electrode switch illustrated FIG. 1 comprises two electrodes, of which one is connected as a cathode 2 and the other as an anode 3, and of which at least the cathode 2 is provided with at least one opening 4. In like manner the anode 3 may also be provided with at least one opening 5. Through the two openings 4 and 5 a discharge gap 8 is ignited. Cathode 2 and anode 3, which in general each have the shape of a solid of rotation, are arranged at a predetermined distance from each other, which may be for example about 1 to 10 mm, preferably about 2 to 5 mm to form the discharge gap 8. The cathode 2 and anode 3 consist of electroconductive material, preferably a special steel. The cathode and anodes may be provided at the discharge gap 8 with special inserts 6 and 7 of a metal of high melting point or they may be made of this high melting point metal entirely. The diameter of the bores 4 and 5 is selected preferably at most as large as, and preferably smaller than, the distance "d" between the electrodes 2 and 3 at the discharge gap 8. Preferably the thickness of cathode 2 is reduced at its opening 4. In particular, the upper edge of opening 4 may be beveled. The thickness of anode 3 may also be reduced at its opening 5. Cathode 2 and anode 3 are connected to an electrically insulating separator forming a part of the wall of a switching chamber 14, which part consists of electrically insulating material, preferably a ceramic, and is filled with a working gas.

The trigger system for the discharge gap 8 includes a hollow electrode 10 disposed in the switching chamber 14 so that its opening is turned toward the discharge gap 8. The distance A of its lower edge from the cathode 2, is less than the length of the cathodic dark space of a glow discharge of the working gas The hollow electrode 10 consists of an electroconductive material, e.g., a special steel, and has at least the form of a dish, preferably the form of a pot, whose depth T is greater than the length of the cathodic dark space of the glow discharge. The form of the pot of the hollow electrode 10 is preferably chosen so that the ratio of the diameter D to the pot depth T is about 0.2 to 2, and preferably about 1. The laterally expanded bottom 11 is provided with compensation openings 15 and 16, fastened in the wall of the switching chamber 14, and led through the wall by an electroconductive connection.

The gas consists of an ionizable gas, preferably hydrogen or deuterium or a mixture of these gases. Also nitrogen or rare gases, such as argon or helium, are suitable, as is known A trigger voltage source 17 is associated with the electrode 10 for example via a limiting resistor 18 and a decoupling capacitor 19. The trigger voltage source 17 supplies a trigger pulse with steep leading edge and a negative voltage of for example about 0.5 to 10 kV, preferably about 1 to 5 kV, against the reference potential of the cathode 2, which may be for example ground potential. The length of the trigger pulse, i.e., the time duration, is at least as great as the switching delay of the discharge gap 8 and may be for example about 0.1 to 2 $\mu$s, preferably about 0.5 to 1 $\mu$s. The hollow electrode also may be connected to a trigger transformer.

Generally the switching chamber 14 also contains a gas tank 24 for the working gas, for example hydrogen or deuterium or a mixture of these gases. This gas tank 24, indicated only schematically in the figure, is provided with a heating system not shown in detail in the figure, the electric terminals of which are led through the wall of the switching chamber 14 and are labeled 25 and 26. In a preferred embodiment of the hollow electrode switch, the gas reservoir of gas tank 24 may preferably serve at the same time as pressure regulating system for the hollow electrode switch.

In another embodiment of the hollow electrode switch of the present invention, the hollow electrode 10 may have associated with it further an additional voltage source 21 for a pre-ionization, the positive voltage of which against the reference potential of cathode 2 may be for example 0.1 to 5 kV and which may be connected to the hollow electrode 10 via a high series resistance 22 of preferably several MOhms. The positive voltage of voltage source 21 is selected so that it produces a low-current glow discharge inside the hollow electrode 10. The low-current is in the current range of for example $\mu$A to some few mA and does not yet lead to breakdown at the discharge gap 8. Such a breakdown is initiated only with the trigger pulse of the trigger voltage source 17. With this hollow electrode switch, where with a hydrogen filling for example the product $p \times d = 150$ Pa mm, one obtains, at an applied voltage $U_o$ between cathode 2 and anode 3 of for example 30 kV and a size of the hollow electrode 10 of for example T=D=20 mm, and with a pre-ionization current $I_v = 0.2$ mA and a negative trigger pulse of $-4.5$ kV, a switching delay of about 50 ns and a jitter which is limited to about 1 ns.

Under certain conditions, in particular at a very small distance A of the hollow electrode 10 from the cathode 2, it may be appropriate to provide additional pressure compensation apertures in the bottom 11. Under certain conditions also the hollow-cylindrical sidewall 12 of the hollow electrode 10 may be provided with such pressure compensation apertures.

In the embodiment of FIG. 1, the trigger voltage source 17 and the additional voltage source 21 for the pre-ionization are electroconductively connected to the bottom 11 of the hollow electrode 10. Under certain conditions, however, it may be appropriate to apply the trigger voltage or the preionization voltage or both at the sidewall 12 of the hollow electrode 10.

In this embodiment of the hollow electrode switch of the present invention with positive switching voltage $U_o$, the grounded upper reference electrode is the cathode 2 and the lower one the anode 3. If a negative switching voltage $U_o$ is applied, the upper grounded electrode is the anode of the discharge gap 8. Independently of the polarity of the switching voltage $U_o$, the reference electrode designated as cathode 2 constitutes the reference potential for the trigger voltage source 17 and the voltage source 21.

In the embodiment, a hollow electrode switch is described which contains only one cathode 2 and an anode 3. Alternatively, however, a multi-electrode arrangement with intermediate electrodes may be provided, with which one obtains a reduced field strength between the electrodes and a correspondingly increased dielectric strength of the hollow electrode switch.

In a further embodiment, the hollow electrode switch contains a plurality of individual discharge gaps arranged parallel to each other and is provided with a common hollow electrode electrically insulated from its reference electrode and with means for establishing a space charge, in particular a glow discharge Thereby one obtains an increase of the rate of current rise and a reduction of the switch inductivity and of the switch resistance as well as a long life and high current load capacity.

Figure 2:
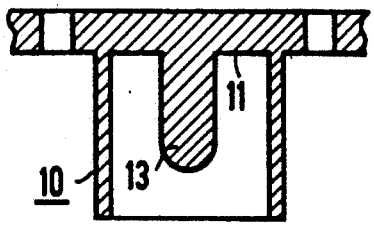
FIGS. 2 and 3 illustrate further the embodiment of the hollow electrode.
Figure 3:
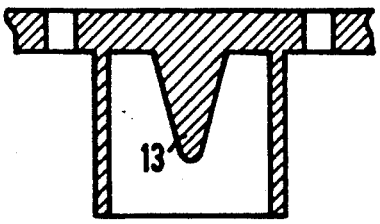

In the embodiment of a hollow electrode 10 according to FIG. 2, the bottom 11 of the hollow electrode is provided with a projection 13, the free end of which is turned toward the discharge gap 8. The projection 13 has the form of a cylinder where the edge of the end is rounded. This projection 13 serves to influence the glow discharge, in particular the distribution of the space charge density, inside the hollow electrode According to FIG. 3, this projection 13 has the form of a cone, the rounded tip of which is turned toward the discharge gap 8.

What is claimed is:

1. A gas discharge switch controlled by a pulsed low pressure gas discharge comprising:

a switching chamber;

a first electrode disposed in said switching chamber;

a second electrode disposed in said switching chamber;

wherein said first and second electrodes are disposed at a distance d from each other, which forms a gas discharge gap;

a trigger system associated with the discharge gap, which comprises a cavity electrode having an open end, said cavity electrode being spaced apart from said first and second electrodes and disposed in said switching chamber, said open end of said cavity electrode facing said discharge gap, said cavity electrode being electrically coupled to a trigger voltage source and forming an anode for the gas discharge;

said switching chamber containing an ionizable gas whose pressure p is selected so that the starting voltage of the gas discharge decreases with increasing product $p \times d$; and said trigger system including means for generating a space charge inside said cavity electrode.

2. The gas discharge switch of claim 1, wherein said first electrode is a reference electrode for a glow discharge inside said cavity electrode and is electrically insulated from said cavity electrode, which is an anode for the glow discharge.

3. The gas discharge switch of claim 2, wherein said trigger system comprises the trigger voltage source for a negative control pulse.

4. The gas discharge switch of claim 3, wherein said cavity electrode is connected to the trigger voltage source via a decoupling resistor and a decoupling capacitor.

5. The gas discharge switch of claim 3, wherein said cavity electrode comprises a substantially rectangularly-shaped electrode with a hollow central region and one open side.

6. The gas discharge switch of claim 2, further comprising means for producing a preionization inside the cavity electrode.

7. The gas discharge switch of claim 6, wherein said cavity electrode is connected via a decoupling resistor to a voltage source for a positive d-c voltage.

8. The gas discharge switch of claim 1, wherein said cavity electrode has a pot-like shape.

9. The gas discharge switch of claim 8, wherein a ratio of the diameter D of a cavity of said cavity electrode to the depth T of the cavity is chosen in the range of 0.2 to 2.

10. The gas discharge switch of claim 9, wherein said ratio of the diameter D to the depth T is about 1.

11. The gas discharge switch of claim 2, wherein a thickness of the reference electrode is reduced in a region adjacent an aperture in said reference electrode.

12. The gas discharge switch of claim 11, wherein an edge of said aperture of the reference electrode turned toward the cavity electrode is provided with a bevel.

13. The gas discharge switch of claim 2, wherein a bottom of the cavity electrode is provided with a projection.

14. The gas discharge switch of claim 13, wherein said projection has a cylindrical shape and has an end turned toward the discharge gap that is provided with a rounded edge.

15. The gas discharge switch of claim 13, wherein said projection has a conical shape and has a rounded tip that is turned toward the discharge gap.

16. The gas discharge switch of claim 1, further comprising a multi-electrode arrangement with intermediate electrodes and a common discharge channel, for which said cavity electrode is intended.

17. The gas discharge switch of claim 2, further comprising a multi-electrode arrangement with intermediate electrodes and a common discharge channel, for which said cavity electrode is intended.

18. The gas discharge switch of claim 1, further comprising a plurality of individual discharge gaps which are arranged parallel to each other and provided with a common cavity electrode which is electrically insulated from a corresponding reference electrode.

19. The gas discharge switch of claim 2, further comprising a plurality of individual discharge gaps which are arranged parallel to each other and provided with a common cavity electrode which is electrically insulated from a corresponding reference electrode.

* * * * *